United States Patent [19]

Beach

[11] 3,942,419

[45] Mar. 9, 1976

[54] BARREL TYPE AIR DIFFUSER

[76] Inventor: Donald Bramston Beach, 10250 Reese Road, Clarkston, Mich. 48016

[22] Filed: Feb. 21, 1974

[21] Appl. No.: 444,402

[52] U.S. Cl. ..... 98/40 A; 98/108

[51] Int. Cl.[2] ..... F24F 13/14

[58] Field of Search ..... 98/40 A, 40 D, 40 N, 40 E, 98/40 V, 108, 121 A

[56] References Cited

UNITED STATES PATENTS

| | | | |
|---|---|---|---|
| 2,528,130 | 10/1950 | Frisk et al. | 98/40 A |
| 2,596,869 | 5/1952 | Ross | 98/40 A X |
| 3,012,494 | 12/1961 | Drummond | 98/40 A |
| 3,361,049 | 1/1968 | Sweeney | 98/40 D |
| 3,461,791 | 8/1969 | Beyer | 98/40 A |

FOREIGN PATENTS OR APPLICATIONS

| | | | |
|---|---|---|---|
| 580,093 | 8/1946 | United Kingdom | 98/40 A |

*Primary Examiner*—William E. Wayner
*Assistant Examiner*—William E. Tapolcai, Jr.
*Attorney, Agent, or Firm*—Burton and Parker

[57] ABSTRACT

An air stream projecting device especially suitable for cooling, heating and ventilating large enclosures by providing both horizontal and vertical control of air streams. The device is usually mounted on the side or end of an air duct and serves as an outlet for the air contained in the duct under pressure. The device includes a rectangular frame in the opening in which a hollow barrel-shaped member is journaled for limited angular movement. One side of the barrel member is opened to the duct to receive air therefrom and the opposite side is opened to discharge air therefrom into the atmosphere of the enclosure. A wall surrounds the discharge opening of the barrel member and projects therefrom beyond the rectangular frame. Carried within the walled opening of the barrel member are a plurality of vanes for directing the discharging air. These vanes are preferably individually pivotally adjustable but may be connected together for joint pivotal movement.

9 Claims, 5 Drawing Figures

BARREL TYPE AIR DIFFUSER

BACKGROUND OF THE INVENTION

Earlier devices of this same general character have been employed but because of certain limitations in their construction and operation they have not been too successful. In such devices a drum or barrel-shaped hollow body wholly enclosed all of the vanes and their side supports therewithin, with the result that not only did these interior parts of the device interfere with and obstruct the flow of air through the hollow-shaped barrel or drum but the disposition of the vanes within the barrel member required dismantling of the device to adjust the vanes, assuming such adjustability was built into the device. As a result of such designs, these earlier air-flow devices were inefficient, lacking convenient adjustment on the one hand for attaining the desired air diffusion and having interior obstructions to air flow which interfered with the volume and throw of the discharged air.

SUMMARY OF THE INVENTION

It is an important object of the invention to provide a highly efficient air stream diffusing equipment for use in cooling, heating and ventilating enclosures.

Another important object of the invention is to provide an improved air stream distributing device attachable to ducts containing air under pressure which is so designed as to discharge a substantially greater volume of air with constant duct pressure and size.

A further important object of the invention is to provide air diffusing equipment having novel provision for convenient adjustment of the direction and throw of the discharged air and without requiring dismantling of any assembled parts of the equipment.

A still further object of the invention is to provide an improved air diffusing unit which avoids interior obstructions to the flow of air therethrough.

In carrying out these and other objects, the present invention contemplates an air diffusing device having provision on the one hand for ready attachment to source of air under pressure and having means on the other hand for conveniently controlling the direction and diffusion of the air stream discharging from the device, and accomplishing these results in a highly efficient manner.

More particularly, the invention comtemplates a stationary portion of the device in the form of a frame member which is attached to an air duct and secured in position around an air opening therein. Mounted interiorly of the frame member is a movable portion of the device in the form of a barrel-shaped member which is cut away on opposites thereof to form aligned side openings in its barrel shape for forming an air passage therethrough. Means carried by the frame member pivotally mounts the barrel member for limited rotating movement about its axis which, in the assembled positions of the parts making up the device, is disposed parallel to the frame member and such that the side openings of the barrel member are located on opposite sides of the plane of the frame member.

A significant feature of the invention is the provision of a walled extension framing the discharge opening of the barrel member which serves as a nozzle for projecting the air stream discharging therefrom in a given direction. Positioned within this nozzle portion of the device are a plurality of vanes or baffles which serve to diffuse the discharging air stream. In a preferred embodiment of the invention, the vanes are individually adjustably mounted as by pivotal mountings for this purpose. For accomplishing the previously mentioned object of convenient adjustability, the vanes are preferably pivotally mounted on parallel axes extending across and through the walled frame around the discharge opening and such that portions of the axes exterior of the walled frame are all beyond the circumference of the barrel-shaped member. Thus, releasable fastening means can be provided exteriorly of the device for permitting adjustable movement of the vanes either individually or collectively if connected to a common control member.

BRIEF DESCRIPTION OF THE DRAWING

Various other objects, advantages and meritorious features of the invention will become more fully apparent from the following specification, appended claims and accompanying drawing figures, wherein:

DESCRIPTION OF A PREFERRED EMBODIMENT OF THE INVENTION

Figure 1:
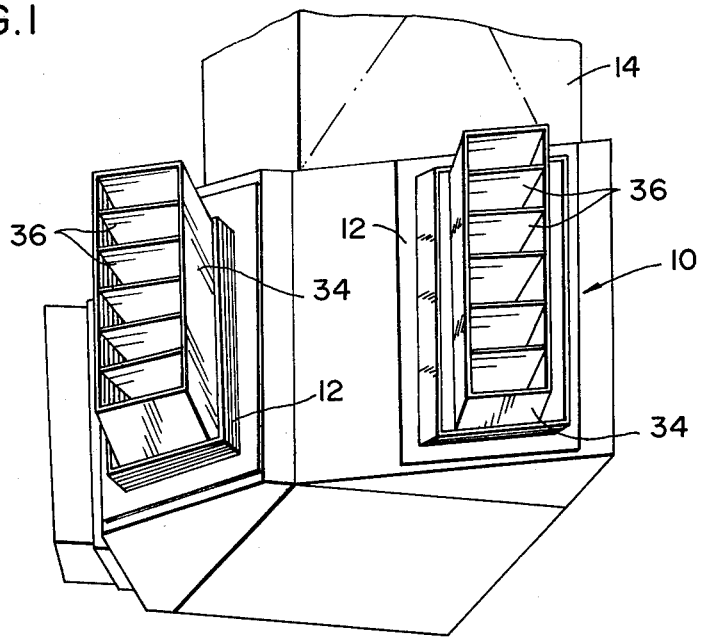
FIG. 1 is a perspective view of a plurality of air diffusing units embodying the invention shown installed in clustering relationship about a large air duct for directing the air therein in several different directions.
Figure 4:
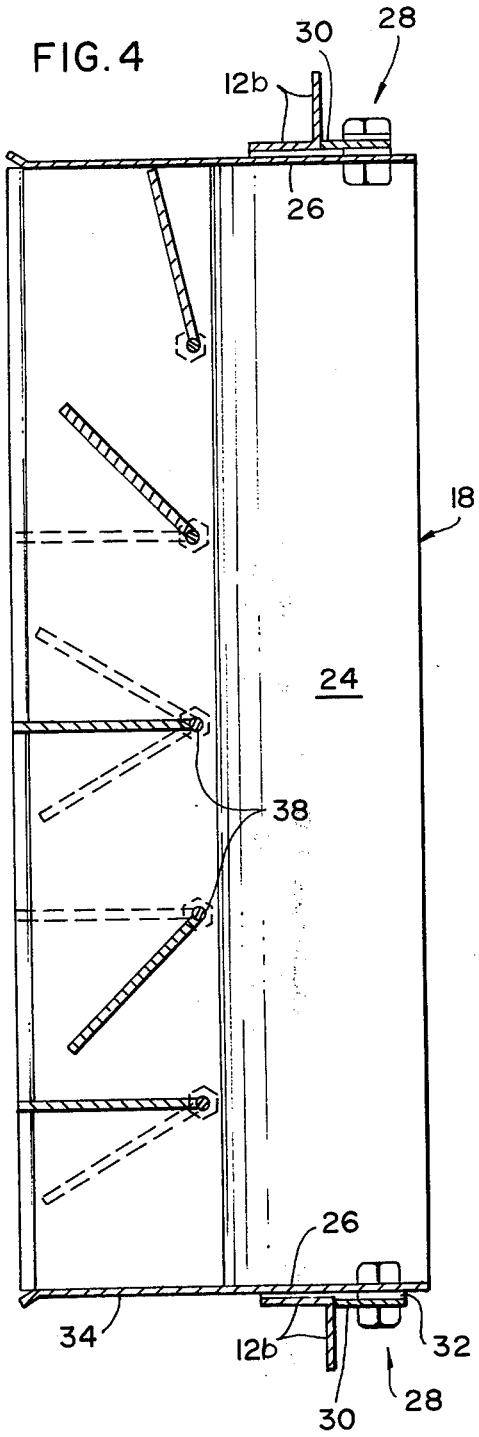
FIG. 4 is a longitudinal sectional view of the unit taken along line 4—4 of FIG. 3.
Figure 5:
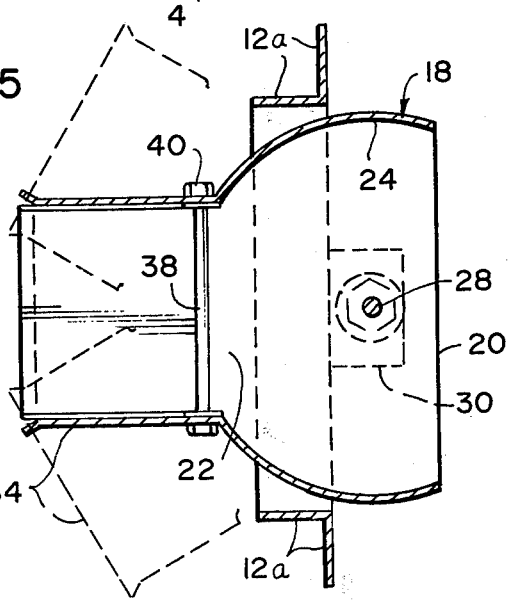
FIG. 5 is a cross sectional view of the unit taken along line 5—5 of FIG. 3.

For such an embodiment of the invention each air diffusing unit 10 comprises a frame member 12, preferably formed of metal and having the rectangular shape shown, which serves to secure the unit onto a duct containing air under pressure, such as illustrated at 14 in FIG. 1, and also to support the operating elements of the unit interiorly of the frame. The side and end sections 12*a* and 12*b* respectively of the frame member 12 are preferably of similar L-shaped cross sections as best shown in FIGS. 4 and 5. The frame member 12 may be apertured at spaced apart locations 16 for receiving bolts or other fastening means for securing the unit to an air duct.

Positioned inside the frame member 12 and occupying nearly all of the space enclosed thereby is a barrel-shaped member generally indicated at 18. One side of this member is opened as indicated at 20 in FIGS. 4 and 5 to form an air inlet to the unit for receiving air under pressure from the duct to which the unit is attached. The side of the barrel-shaped member 18 opposite to the inlet opening 20 is likewise opened as indicated at 22 to form an air outlet from the interior of the barrel member as best shown in FIG. 5. The result is that the barrel member is fairly extensively reduced from a conventional barrel shape but still retains the major portions of the cylindrical side wall 24 and opposite end walls 26—26.

The barrel member 18 is mounted within the frame member for limited rotation about its axis on pivot mounts generally indicated at 28—28 and individually secured to the end sections 12*b* of the frame. Preferably, each pivot mount is positioned in place by a metal plate 30 secured to the end section 12*b* of the frame in inwardly projecting relationship as shown. The pivot mounts may be of any suitable form and are herein shown as comprising a bolt extending through the plate 30 and the end section 12b of the frame and carrying a pair of nuts on its opposite extremities which when loosened will permit the barrel member to pivot and when tightened to hold the barrel member in adjusted position. A spacer 32 on each bolt may be located between the end walls 26 of the barrel member and each plate 30. It is evident that by virtue of the two pivot mountings 28—28, the axis of the barrel member 18 is located parallel to the plane of the frame 12 and such that the inlet 20 of the barrel member is positioned on the duct side of the frame and the outlet 22 is disposed on the other side of the frame as illustrated in FIG. 5. It is also evident from the drawing figures that the outlet or discharge opening 22 of the barrel member has the same length as the inlet opening 20 but approximately one half the width thereof.

Carried by the barrel member, and preferably forming an integral part thereof, is a walled extension 34 which surrounds the outlet opening 22 of the barrel member 18 and preferably has a depth in the direction of air flow of nearly the distance separating the inlet and outlet openings of the barrel member. Dimensionally, the walled extension 34 is preferably rectangular in transverse cross section and its air discharge opening is of the same extent as the discharge outlet 22 of the barrel member. In operation, the walled extension 34 forms a spout or nozzle for directing the air under pressure which it receives from the barrel member in a given direction from the duct to which the whole assembly is attached.

Figure 2:
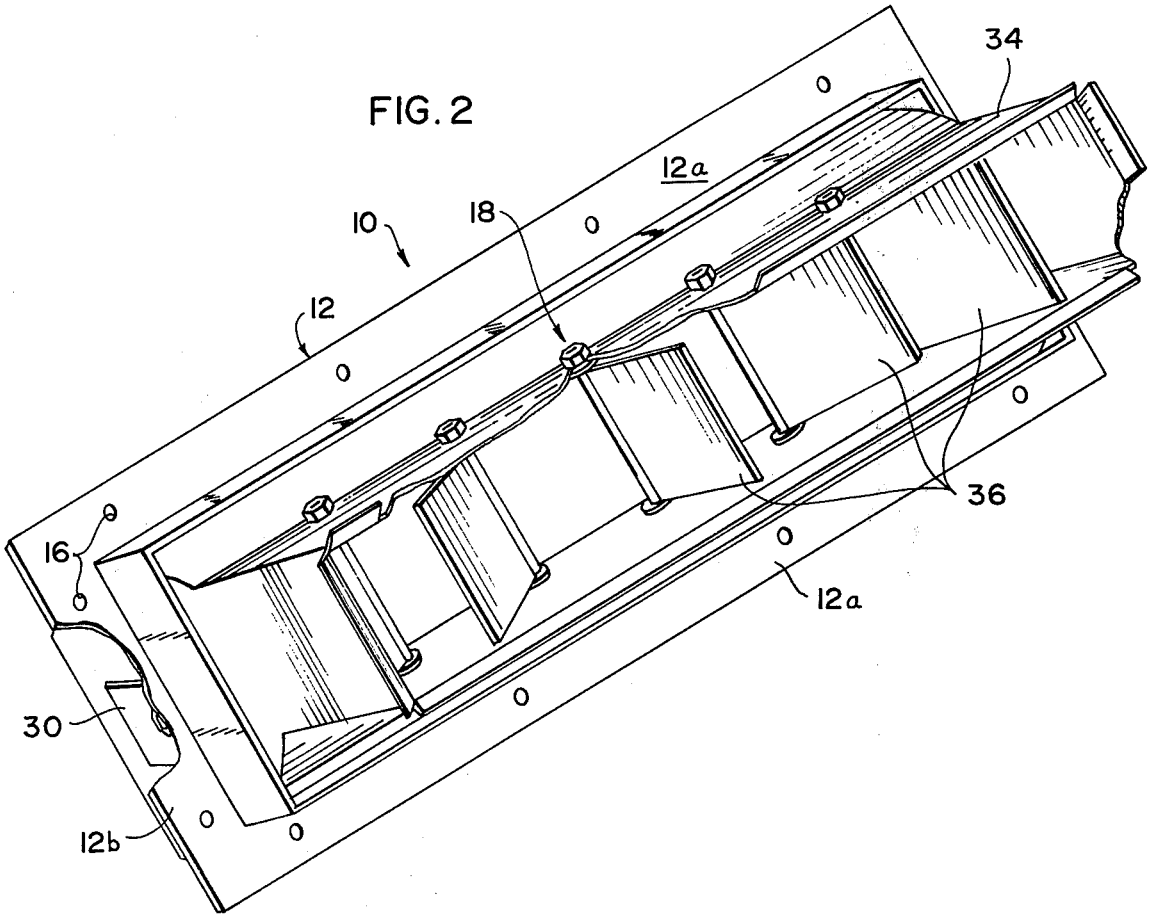
FIG. 2 is a perspective view of an individual one of the units embodying the invention showing in larger scale the air discharge side thereof.
Figure 3:
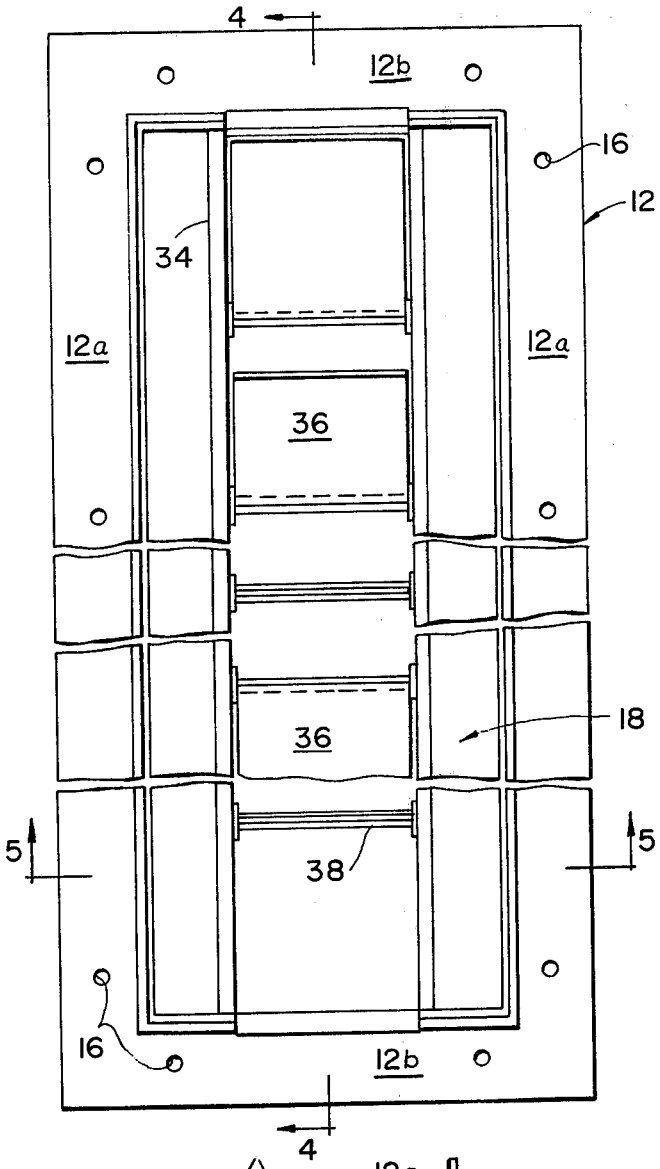
FIG. 3 is a plane view of the unit of FIG. 2 showing the air input side thereof.

Distributed at spaced locations in the walled extension 34 are a plurality of vanes or baffles 36. It is preferred that most if not all of these vanes be pivotally mounted within the walled extension or outlet duct 34 of the barrel-shaped member and such that the vanes may be pivotally adjusted to assume a desired fixed position within the nozzle. Varied positions of the vanes are illustrated in FIGS. 2, 3 and 4. The illustrated vanes are flat plate-like members fitting with relatively close tolerance the inside dimensions of the walled extension 34. The vanes are fixedly mounted on rods 38 extending crosswise of the air flow passage of the walled extension preferably at equally spaced-apart intervals therewithin. The rods 38 may be formed by long bolts having their extremities passing through the side walls of the extension 34 and having a head at one end and receiving a nut 40 threaded on the other end. Each vane is individually associated with a rod 38 and has its inner edge welded or otherwise secured to the shank of its associated rod so that these welded parts of the assembly are jointly rotatable about the axis of the bolt when the nut on the bolt is unthreaded sufficiently to permit this rotation. When angled to the desired amount, each vane is fixed in adjusted position by tightly threading its nut home against the adjacent side wall of the outlet duct 34. As a result of the extension of the barrel-shaped member 18 beyond its outlet opening to form the nozzle or air discharge duct 34, the opposite ends of the pivot pins or rods 38 are able to be disposed outside of the curvature of that surface of revolution conforming to the cylindrical wall 24 of the barrel member thereby enabling convenient external access to the nuts 40 for adjusting the angularity of the vanes 36 and without requiring dismantling of the air diffusing unit 10. Moreover, by locating the middle portions of the rods 38 within the surface of revolution of the barrel member, as best illustrated in FIG. 5, the rods are positioned close to the inner end of the outlet duct 34 with the result that the vanes are extended forwardly therefrom in the general direction of the air flow. It also it is apparent that the barrel member 18 together with its outlet duct 34 can be adjustably rotated as indicated in FIG. 5 and then fixed in adjusted position at the time of installation in the main air duct 14 to which the air diffuser unit is attached.

While a particular embodiment of the invention has been shown and described, it will be understood, of course, that it is not desired that the invention be limited thereto since modifications may be made, and it is therefore contemplated by the appended claims to cover any such modifications as fall within the true spirit and scope of the invention.

What I claim is:

1. A barrel-type air diffuser for providing both horizontal and vertical controls of air streams including, in combination:

a frame member providing a central rectangularly-shaped opening;

a barrel-shaped member fitting the opening of the frame member with slight clearance with the side and end sections thereof, said barrel member being opened along one side to serve as an air inlet and being opened on the opposite side to serve as an air outlet;

pivot mounts carried by the frame member and connected to the barrel member for providing limited rotation thereof about an axis generally corresponding to that of the barrel member and disposed parallel to the plane of the frame member;

an outlet duct mounted on the barrel member in surrounding relation to the air outlet opening thereof and having the side and end walls thereof projecting outwardly beyond the opening to serve as a nozzle for controlling the direction of the air stream discharged through the outlet opening of the barrel member;

a plurality of similarly formed vanes mounted crosswise in the outlet duct of the barrel member in spaced apart relation to one another for further controlling the direction of the air stream discharged from the outlet duct; and said air inlet of the barrel member as well as the interior of the barrel member being free of any obstruction to the flow of air through the barrel member to the outlet duct.

2. The air diffuser defined in claim 1 wherein said plurality of vanes are each mounted for pivotal movement about parallel axes extending across the outlet duct from one side wall section to the opposite side wall section thereof, and wherein a part of each vane extends through one of said side wall sections of the outlet duct for adjusting the pivotal position of the vane.

3. The air diffuser defined in claim 2 wherein the part on the outlet duct for adjusting the pivotal positions of the vanes comprises a pivot rod fixedly associated with each vane for joint pivotal movement having an end portion of the rod extending through a side wall section of the duct adjacent to but forwardly of the curved exterior of the barrel shaped member, and means on the end portion of each such rod for releasably locking its associated vane in pivotally adjusted position.

4. The air diffuser defined in claim 3 wherein the means for releasably locking each vane in pivotally adjusted position is a member threadedly engaging the end portion of each rod and operative to releasably clamp the rod and its vane to the wall section of outlet duct through which the end portion of the rod extends.

5. The air diffuser defined in claim 4 wherein the interior cross sectional area of the air outlet opening of the barrel-shaped member is approximately half that of the air inlet opening of the barrel-shaped member.

6. A barrel-type air diffuser for controlling the direction of air streams including, in combination:

a frame member providing a central rectangularly-shaped opening;

a barrel-shaped member substantially fitting the opening of the frame member and having side portions thereof located on opposite sides of the plane of the frame member, the cylindrical wall of said barrel-shaped member being opened along one side portion to serve as an air inlet and being opened on the opposite side portion to serve as an air outlet;

pivot mounts carried by the frame member and connected to the barrel member for providing limited rotation thereof about an axis generally corresponding to that of the barrel member and disposed parallel to the plane of the frame member;

an outlet duct mounted on the barrel member in surrounding relation to the air outlet opening thereof and having its side and end wall sections thereof projecting forwardly beyond the opening to serve as a nozzle for controlling the direction of the air stream discharged through the outlet opening of the barrel member;

a plurality of vanes mounted crosswise in the outlet duct of the barrel member in spaced apart relation to one another and further acting to control the direction of the air stream discharged from the outlet duct, each of said vanes being secured to a pivot rod which has an end portion thereof extending through a side wall of the outlet duct and projecting externally of the duct and forwardly of the curvature of that surface of revolution conforming to the cylindrical wall of the barrel-shaped member;

means operatively associated with the externally projecting end portion of each such pivot rod for releasably locking its associated rod and vane in pivotally adjusted position in the outlet duct; and said air inlet of the barrel member as well as the interior of the barrel member being free of any obstruction to the flow of air through the barrel member to the outlet duct.

7. The air diffuser defined in claim 6 wherein the rods for said plurality of vanes are mounted for pivotal movement about parallel axes extending across the outlet duct from one side wall section to the opposite side wall section thereof, the mid portions of said rods being located within the curvature of that surface of revolution conforming to the circumference of the barrel member.

8. The air diffuser defined in claim 7 wherein the means for releasably locking each vane in pivotally adjusted position is a nut which threadedly engages the externally projecting end portion of each rod and which is operative when threaded in one direction to releasably clamp the rod to the outlet duct thereby to hold the rod and its vane in adjusted position.

9. A barrel-type air diffuser for controlling the direction of air streams including, in combination:

a barrel-shaped member dimensionally shaped to fit within the opening of an air duct such as to have side portions thereof located on opposite sides of the plane of the duct opening, the cylindrical wall of said barrel-shaped member being opened along one side portion to serve as an air inlet and being opened on the opposite side portion to serve as an air outlet;

pivot mounts carried by the barrel-shaped member for mounting the same in an opening in an air duct for rotation about an axis generally corresponding to that of the barrel member and disposed parallel to the plane of the duct opening in which the barrel member is installed;

an outlet duct mounted on the barrel member in surrounding relation to the air outlet opening thereof and having its side and end wall sections thereof projecting forwardly beyond the opening to serve as a nozzle for controlling the direction of the air stream discharged through the outlet opening of the barrel member; a plurality of vanes mounted crosswise in the outlet duct of the barrel member in spaced apart relation to one another and further acting to control the direction of the air stream discharged from the outlet duct, each of said vanes being secured to a pivot rod which has an end portion thereof extending through a side wall of the outlet duct and projecting externally of the duct, and beyond the curvature of that surface of revolution conforming to the cylindrical wall of the barrel-shaped member;

means operatively associated with the externally projecting end portion of each such pivot rod for releasably locking its associated rod and vane in pivotally adjusted position in the outlet duct; and said air inlet of the barrel member as well as the interior of the barrel member being free of any obstruction to the flow of air through the barrel member to the outlet duct.

* * * * *